United States Patent [19]

Pedersen

[11] 3,960,641

[45] June 1, 1976

[54] MEANS FOR APPLYING LABELS TO A SHEET MATERIAL LENGTH

[75] Inventor: Henning Kristen Pedersen, Vejle, Denmark

[73] Assignee: Gert Oestergaard, Vejle Plastic, Denmark

[22] Filed: Nov. 7, 1972

[21] Appl. No.: 304,409

[30] Foreign Application Priority Data

Nov. 11, 1971 United Kingdom ..... 52412/71

[52] U.S. Cl. ..... 156/362; 156/354; 156/497; 156/519; 156/522; 156/568; 156/DIG. 25; 156/DIG. 31; 156/DIG. 45

[51] Int. Cl.[2] ..... B65C 9/42

[58] Field of Search ..... 156/264, 265, 521, 542, 156/566, 567, 522, 552, 354, 353, 355, 519, 515, 511, 530, 358, 568, 506, 362, 497, DIG. 25, DIG. 31, DIG. 45

[56] References Cited

UNITED STATES PATENTS

| | | | |
|---|---|---|---|
| 2,543,004 | 2/1951 | Dewyer | 156/521 |
| 3,117,051 | 1/1964 | Kornblum | 156/506 |
| 3,147,166 | 9/1964 | Friday | 156/264 |
| 3,392,636 | 7/1968 | Lindley | 156/522 |
| 3,554,822 | 1/1971 | Schwarzkopf | 156/522 |
| 3,576,695 | 4/1971 | Stine | 156/264 |
| 3,765,992 | 10/1973 | Stageberg | 156/521 |

*Primary Examiner*—William A. Powell
*Assistant Examiner*—Jerome W. Massie
*Attorney, Agent, or Firm*—Craig & Antonelli

[57] ABSTRACT

A method of consecutively applying pieces of sheet material to a moving sheet material length preferably for securing reinforcing sheet pieces to the handle hole areas of a sheet length for the production of carrier bags, comprising advancing the sheet material length past an application station in which a strip of sheet material is successively fed to a number of movable carrier plates, cutting the sheet strip between consecutive carrier plates so as to leave a sheet piece on the leading plate or plates, moving the carrier plates successively into a working position adjacent the surface of said sheet length and pressing the carrier plate in this position with said sheet piece temporarily held thereon against said surface so as to transfer the sheet piece to the sheet length, retracting the carrier plate and moving the next carrier plate into said working position while advancing the sheet length further, characterised by feeding the sheet strip to carrier plate facets on a rotary carrier body and effecting the transfer of the sheet pieces to the sheet length by moving the entire carrier body against the sheet length. The sheet pieces or labels may hereby be applied to the sheet material length with short time intervals, i.e. a high production speed is obtainable, also because the carrier body may be rotated during its movement towards and /or away from the sheet length. The invention further comprises a machine for carrying out the said method, this machine being provided with the said rotatable carrier body for the sheet pieces.

29 Claims, 2 Drawing Figures

MEANS FOR APPLYING LABELS TO A SHEET MATERIAL LENGTH

Figure 1:
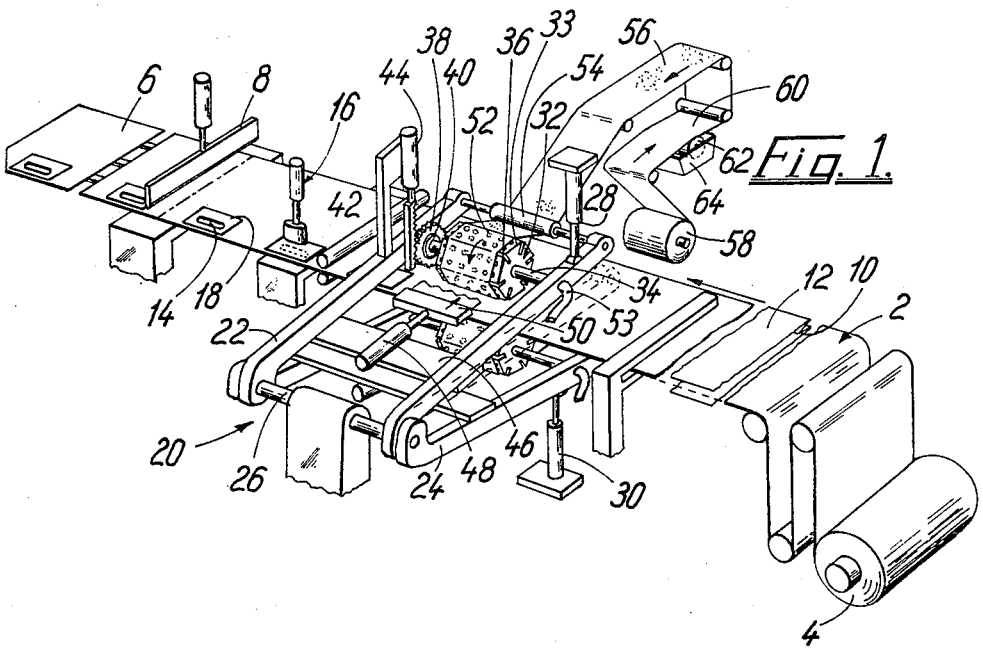

The present invention relates to a method and a machine for applying single pieces of a sheet material to a length of sheet material, especially, though not exclusively for use in the production of carrier bags of the type having handle holes which are reinforced by a sheet piece secured to the bag side around each hole. The reinforcing of the handle hole areas has normally been carried out by securing a continuous reinforcing strip along the open edge of a material length folded along its other edge, whereafter the handle holes are punched out in the reinforced area and the single bags are formed by consecutively crosswise cutting material the front end of the mateial length by a combined cutting and welding operation, whereby the closed side edges of the bag members are formed.

A continuous reinforcing strip is easy to apply to the sheet length also at high working speed, but since the reinforcing material serves its purpose only adjacent the handle holes a certain waste of strip material will be involved. It has been endavoured, therefore, to secure single reinforcing pieces or labels to the bag material length, but generally this has not been successful, mostly because the obtainable production speed has been unsatisfying.

In the Swiss patent specification No. 470.963 there is disclosed a method of applying reinforcing labels to a sheet material length for the production of carrier bags of the so-called bottom welded type, the sheet length being a flat tube with folded side edges from the front end of which the single bags are consecutively cut off by means of a tool welding the sheet layers together along a transverse line and cutting them along this line at one side thereof, so as to form a closed bottom of one bag and an open top of the adjacent bag, the bag side edges being identical with the side edges of the sheet length. Handle holes are punched out midways between the edges of the sheet length in order to be positioned correctly midways in the top portion of the bag sides. Prior to this punching the sheet length passes an application station in which a reinforcing label or sheet piece is applied to each side of the sheet length at the place to be punched. In this station a strip of sheet material is successively fed to an endlessly moving row of carrier plates and is cut between these plates so as to form single labels temporarily held on the carrier plates by being transfixed on needle points thereon. The carrier plates are moved in a chainlike manner successively into a working position in which means are provided for pressing the consecutive plates against the surface of the sheet length so as to transfer the labels thereto, the labels in advance being provided with a suitable adhesive for sticking to the sheet material.

The invention relates to a method of this character and has for its object to provide a method enabling the production to be carried out at high speed, which is in practice of utmost importance.

According to the invention this is obtainable be feeding the sheet strip to carrier plate facets on a rotary carrier body and effecting the transfer of the sheet pieces to the sheet length by moving the entire carrier body against the surface of the sheet length. It is in this manner not necessary to await the establishing of a driving connection between the carrier plate to be operated and the said pressing means therefor after the carrier plate having reached its working position, since this driving connection may be established permanently to the shaft of the rotary carrier body around which it is rotated for bringing the consecutive carrier plates into the working position, i.e. the rotating and pressing movements may take place in direct continuity of each other and even — which is an important feature — with a considerable overlapping of each other, i.e. the rotation may be started as soon as the body starts being lifted from the sheet length and stopped just before the body is again pressed against the sheet length. Thus there will be very little waste time in the operation. Moreover due to the lack of special pressing means behind the single operative carrier plate the rotary body may be made compact with small diameter and few plate facets, e.g. 4–12 facets, whereby it may be so light that it can very rapidly be accelerated and decelerated by its stepwise rotation.

The invention also comprises a machine for carrying out the method of the invention, this machine comprising the said rotary carrier body mounted so as to be reciprocable towards and away from the sheet length passing through the machine.

Figure 2:
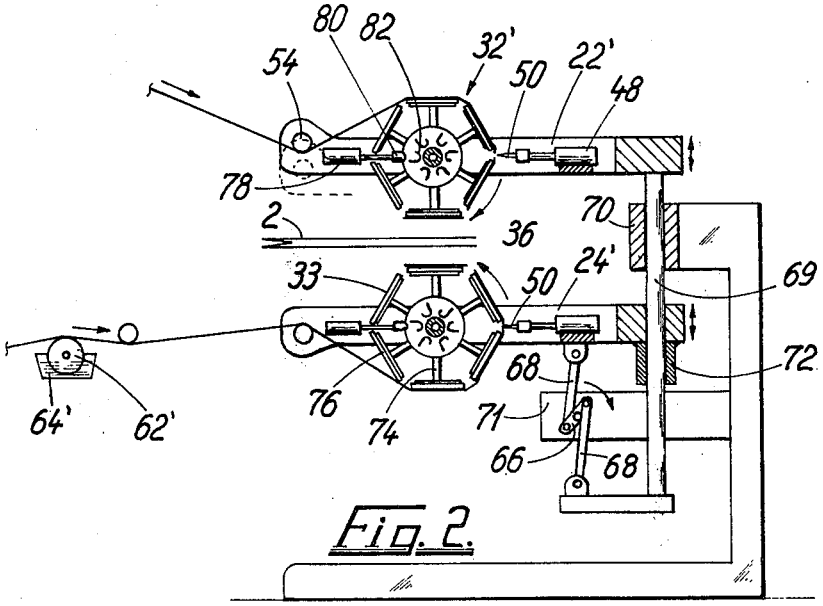

The invention by way of example is described in more detail in the following with reference to the accompanying drawing in which:

FIG. 1 is a schematical perspective view of a bag making machine according to an embodiment of the invention, whilst FIG. 2 is a side view of a preferred embodiment of the means for applying reinforcing labels to the bag material.

The machine shown in FIG. 1 comprises commonly known means for moving a length 2 of folded plastic foil material from a supply roll 4 through different working stations in the machine until at the end of the machine the single carrier bags 6 are consecutively separated from the length by means of a crosswise arranged welding and cutting tool 8. In the example shown the length 2 has a double fold 10 at one side while it is simply open along the other side, as illustrated for the sake of clearness by a slightly opened section 12 adjacent the right hand end of the length. From this it will be clear that the bags to be produced in the example shown are of the type having a bottom fold 10 and no side folds. Furthermore the bags are of the type having a handle hole 14 which is made in a punching station 16 and which is reinforced by means of a label 18 secured to each of the bag sides around the hole 14. The invention is concerned with the manner in which these labels are secured to the bag sides.

The bag material length 2 passes a label applying station 20 in which there is provided one label applying structure above and one underneath the length 2. These two structures are mounted on carrier frames 22 and 24, respectively, these frames being mounted on a common, rigid shaft 26 and adapted to be swung towards and away from each other, e.g. by means of working cylinders 28, 30 respectively. Since the two structures are very similar, only the uppermost of them will be described in detail.

Between the arms of the frame 22, in a position somewhat inside the open edge of the bag material length 2, there is rotatably mounted a hexagonal cylindrical carrier body 32 the rotatable shaft of which is designated 34, while the surface facets thereof are designated 33. Along each of the corner lines of this body there is provided a slot 36. On the shaft 34 there is mounted a toothed wheel 38 engaging the shaft through a one way coupling 40 in such a manner that the wheel 38 may rotate the body 32 in anticlockwise direction only, as shown by an arrow. The wheel 38 is adapted to be driven by means of a tooth rack 42 mounted on the piston rod of a cylinder 44 rigidly mounted on the frame 22. The cylinder is adjusted to impart to the tooth rack 42 a movement up and down corresponding to rotation of the body 32 through exactly one sixth of a revolution.

On a frame element 46 there is mounted a working cylinder 48 having its piston rod connected member 50 which is situated so as to be able to penetrate into that of the slots 36 in the body 32 which faces the knife in a given position of rest of the body 32.

The six plane surfaces 33 of the body 32 are provided with a number of suction holes 52 connected to a vacuum source (not shown) through the hollow shaft 34 and a hose 53.

Across the exterior end of the frame 22 there is mounted a rotatable roller 54 serving as a guiding roller for a strip 56 of a plastics material having the width of the handle labels 18 and being supplied from a roll 58 over various guiding rollers as shown. The front end of this strip 56 is held on several of the facets 33 of the body 32 by the suction applied to the holes 52. When the body 32 rotates, therefore, the strip 56 will be drawn along and consecutively be laid upon the following facets 33. If desired the suction holes 52, in a manner not shown, may be substituted by short needle points projecting from the facets 33, as known per se. Alternatively the facets may be prepared so as to be permanently moderately sticky.

The strip 56 has an inverted run 60 in which it passes over a roller 62 the lower portion of which is immersed into a bath 64 of glue so that the lower surface of the strip 56 in this run will be provided with a glue layer which in the later run will appear on the upper surface of the strip, i.e. on the surface exposed on the body facets 33.

The lower label applying device is made in a similar, though mounted in an inverted manner, and it should thus need no further description.

The device operates as follows:

Beforehand the front end of the strip 56 is laid onto the three facets 33 which are visible in FIG. 1. The knife carrying cylinder 48 is operated so as to cause the strip end on the lower of the visible facets to be cut off from the remaining strip and form a label, and the body 32 is rotated one-sixth revolution so as to bring the facet with the newly made label down into a position overhead the sheet length 2. The lower carrier body in the frame 14 is prepared in a corresponding manner.

When thereafter the cylinders 28 and 30 are actuated the frames 22 and 24 are swung down and up, respectively, until the operative facets 33 facing the sheet length 2 are pressed against each other with the length 2 and the respective labels located therebetween. By this pressing the labels present on the clamping facets will be brought to adhere to the bag material since their adhering sides face this material. Therefore, when the frames 22 and 24 are thereafter returned to their retracted positions the said labels will be left on the bag material, the suction in the holes 52 either being cut off or being adapted so as to not prevent a forced retraction of the labels from the facets 33. Thereafter the cylinders 44 are actuated so as to bring the next label into the position ready for transfer to the bag material, and the frames are again clamped together. The knife 50 is operated by means of the cylinder 48 every time the body has rotated one-sixth revolution so as to consecutively prepare the separate labels to be transferred to the length 2.

In the meantime the bag material length 2 is moved stepwise so that the labels 18 are mounted thereon with the correct spacing. As mentioned, the material length thereafter passes a punching station 16 for the handle holes 14 and a bag separating tool 8.

Principially it would be possible to apply the labels 18 during continuous movement of the main length 2 by reciprocating the whole label applying device in the direction of the length 2.

FIG. 2 shows a preferred embodiment in which the carrier frames 22' and 24' are mounted for vertical reciprocation driven by a crank mechanism 66 which is connected to suitable parts of the two frames by means of connector rods 68, the frames being guided e.g. as shown, i.e. with a rod 69 depending from the upper frame 22' and slidably held in a stationary bushing 70; the lower end of this rod is connected with one of the rods 68, and moreover the rod 69 passes through a slide bushing 72 on which the lower frame 24' is secured, this frame being directly coupled to the crank 66 by means of the other of the rods 68. The crank 66 is rotatably mounted in a stationary chassis portion 71 and is driven so as to rotate with constant speed whereby the carrier bodies 32' are moved steadily up and down, also during their own stepwise rotation.

FIG. 2 also shows a modified embodiment of the carrier bodies, these here being made with radial arms or ribs 74 projecting from a hub and having outer facet plates 76 constituting the facets 33; it should be endavoured to make the rotary bodies as light as reasonably possible.

The means 44 for rotating the carrier bodies are not shown in FIG. 2, but it is shown that on one end surface of these bodies there may be provided a circular row of centering sockets 82 cooperating with a centering head 80 on the piston rod of a working cylinder 78 secured to the carrier frame, whereby the carrier body may be temporarily locked and centered each time it has been rotated into a new working position.

The invention is not limited to the embodiments shown, thus it may well be used for making bags of the bottom welded type, i.e. for placing reinforcing labels midways between the edges of the sheet length 2. On the other hand it is an important feature that by the crosswise feeding of the strip 56 relatively to the length 2 it is possible, in the manner shown, to produce side welded bags with high production speed, because the carrier bodies 32 can be rotated in the direction of the shorter sides of the rectangular facets 33, i.e. the change from one facet to the next can be done rapidly by a short way of displacement. Obviously, however, it would be possible to arrange the rotary carrier bodies with their axes extending in other directions, even crosswise of the length 2.

The invention may be used for applying labels to a material length for purposes other than reinforcing, e.g. decorative labels or pocket forming labels. The labels may be applied at one side of the length only, e.g. pairwise adjacent opposed edges of a single layer length which is thereafter folded along its middle line in order to produce carrier bags with the handle reinforcing labels mounted inside the bag.

What is claimed is:

1. A machine for consecutively applying pieces of sheet material to a moving sheet material length comprising advancing means for advancing a sheet length past a sheet piece applicating station in which movable carrier means constituted by a closed row of carrier plate elements are provided in such a manner that these elements are consecutively movable from a receiving position in which they are operable to receive a layer of a sheet material to a working position adjacent said sheet length, said elements in said working position co-operating with movement control means for moving the elements between a retracted position spaced from the surface of said sheet length and a transfer position in which they press the said sheet layer against the sheet length surface, the carrier plate elements being constituted by facets on a rotary carrier body, said movement control means being constituted by means for reciprocating the entire carrier body between said retracted position and said transfer position.

2. A machine according to claim 1, in which the carrier body is provided with a maximum of twelve carrier plate facets 3. A machine according to claim 2 in which the carrier body is provided with six carrier plate facets.

4. A machine according to claim 1, in which the carrier body as well as the means for rotating the carrier body are mounted in a carrier chassis operable to be reciprocated.

5. A machine according to claim 1, in which the means for rotating the carrier body are controlled so as to effect at least a part of the rotation during the operation of the means for reciprocating the carrier body 6. A machine according to claim 1, in which the carrier body is mounted in a carrier chassis which is reciprocally movable by means of connector rods connecting it with a continuously rotating crank mechanism.

7. A machine according to claim 1, in which the carrier plate facets are provided with suction holes connected to a vacuum source 8. A machine according to claim 1, in which the rotary carrier body is mounted on a shaft extending substantially parallel to the longitudinal direction of the sheet material length.

9. A machine according to claim 8 including two carrier means, one carrier means being located on each side of the sheet material length for producing carrier bags with reinforcing sheet pieces mounted around handle holes in the bag sides, the carrier plate facets of the rotary carrier body at each side of the sheet length being rectangular with their largest extension oriented lengthwise of the sheet length, the carrier bodies being mounted so as to be operable to apply the sheet pieces to the sheet length near one side edge thereof, whereby said machine is adapted to produce carrier bags with handle holes from a double sheet length folded at the other side edge thereof by successively separating single bags from the front end of the double sheet length by means of a tool serving to cut the sheet length along a transverse line and weld together the sheet layers along this line.

10. A machine according to claim 9, wherein the advancing means is adapted to advance a continuous sheet length to and away from said sheet piece applicating station in such a way that said carrier bodies apply said sheet pieces to successive portions of said continuous sheet lengths as said successive portions are passed to and away from said sheet piece applicating station.

11. A machine according to claim 1, wherein said advancing means comprises means for advancing a continuous sheet length past a sheet piece applicating station.

12. A machine according to claim 1, further including severing means for severing said continuous sheet length after leaving said applicating station, whereby said continuous sheet length is separated into a number of sheet segments, each sheet segment having a piece of sheet material applied thereto.

13. A machine according to claim 1, wherein the advancing means is adapted to advance a continuous sheet length longitudinally to and away from said sheet piece applicating station, said machine further comprising severing means for severing said continuous sheet length into sheet segments after leaving said sheet piece applicating station.

14. A machine according to claim 1, wherein said advancing means is constructed to advance said sheet length past said sheet piece applicating station in the longitudinal direction of said sheet length.

15. A machine according to claim 14, wherein said advancing means comprises means for moving a continuous sheet length past said piece applicating station.

16. A machine according to claim 15, wherein said advancing means is constructed to advance said sheet length stepwise in the longitudinal direction of said sheet length.

17. A machine according to claim 16 further comprising means for controlling the operation of said carrier plate elements for application of pieces of sheet material to said moving sheet material length with a constant predetermined mutual spacing therealong.

18. A machine according to claim 1 further comprising means for controlling the operation of said carrier plate elements for application of pieces of sheet material to said moving sheet material length with a constant predetermined mutual spacing therealong.

19. A machine according to claim 1 including two carrier means, one carrier means being located on each side of the sheet material length.

20. A machine according to claim 19, wherein said carrier means are located oppositely one another with respect to said sheet material length, whereby said carrier means can be moved together and apart as they are reciprocated between their respective retracted positions and transfer positions.

21. A machine for consecutively applying pieces of sheet material to a moving sheet length comprising means for advancing a sheet length past a sheet piece applying station, applicator means located in said applying station and comprising a rotary carrier body having a peripheral row of sheet piece carrying surface portions operable to temporarily hold a front end portion of a sheet piece material strip and wind said material strip partly onto said carrier body in response to rotation thereof, cutting means for consecutively cutting the strip material between two successive of said surface portions so as to consecutively form a cut off sheet piece held by the leading one of said two successive surface portions, means for reciprocating said carrier body between a position in which said carrier body is spaced from the surface of said sheet material length and an applicator position in which the leading surface portion of said carrier body is pressed against the surface of the material length to transfer the sheet piece temporarily held by said leading surface portion to the surface of the sheet material length, and means for rotating said carrier body step-wise so that a successive surface portion of said carrier body is pressed against the surface of said material length each time said carrier body is moved to said applicator position, said means for advancing the sheet material length being controlled so as to advance the sheet material length during at least a part of the time interval when the carrier body is out of pressing contact with the surface of the material length.

22. A machine according to claim 21, wherein said means for reciprocating said carrier body is controlled so as to press said carrier body against the sheet material length surface for transfer of the sheet piece held by said successive surface portion of said carrier body upon step-wise rotation of said carrier body and when said sheet material length has been advanced corresponding to the desired distance between consecutive sheet pieces thereon.

23. A machine according to claim 22, including two carrier bodies, one carrier body being located on each side of said sheet material length.

24. A machine according to claim 23, wherein said carrier bodies are positioned opposite to one another with respect to said sheet material length, the means for reciprocating each of said carrier bodies being constructed so as to press said carrier bodies against opposite surfaces of said sheet material length so that each carrier body constitutes a pressure backing element for the other carrier body, whereby said material length remains within its advancing path during contact with said carrier bodies.

25. A machine according to claim 21, wherein said advancing means is constructed to advance said sheet length past said sheet piece applicating station in the longitudinal direction of said sheet length.

26. A machine according to claim 25, wherein said advancing means comprises means for moving a continuous sheet length past said piece applicating station.

27. A machine according to claim 26, wherein said advancing means is constructed to advance said sheet length stepwise in the longitudinal direction of said sheet length.

28. A machine according to claim 27 further comprising means for controlling the operation of said applicator means for application of sheet pieces to said moving sheet length with a constant predetermined mutual spacing therealong.

29. A machine according to claim 21 further comprising means for controlling the operation of said applicator means for application of sheet pieces to said moving sheet length with a constant predetermined mutual spacing therealong.

* * * * *